US005657113A

United States Patent [19]

Ono et al.

[11] Patent Number: 5,657,113

[45] Date of Patent: Aug. 12, 1997

[54] DOCUMENT EXPOSURE APPARATUS

[75] Inventors: Katsuhiko Ono; Tsuyoshi Seto; Yutaka Watanabe, all of Kanagawa, Japan

[73] Assignee: Fuji Xerox Co., Ltd., Tokyo, Japan

[21] Appl. No.: 384,373

[22] Filed: Feb. 3, 1995

Related U.S. Application Data

[63] Continuation of Ser. No. 25,719, Mar. 3, 1993, abandoned.

[30] Foreign Application Priority Data

Mar. 4, 1992 [JP] Japan ..... 4-047035

[51] Int. Cl.[6] ..... G03G 21/00

[52] U.S. Cl. ..... 355/75; 355/120; 399/187

[56] References Cited

U.S. PATENT DOCUMENTS

| | | | |
|---|---|---|---|
| H43 | 4/1986 | Michaels | 355/75 |
| 4,912,507 | 3/1990 | Kinoshita | 355/203 |
| 5,077,579 | 12/1991 | Shibusawa et al. | 355/309 |
| 5,142,326 | 8/1992 | Iwata et al. | 355/208 |

FOREIGN PATENT DOCUMENTS

| | | |
|---|---|---|
| 53-46016 | 11/1978 | Japan . |
| 58-12176 | 3/1983 | Japan . |
| 59-52230 | 3/1984 | Japan . |

OTHER PUBLICATIONS

"1990–1991 Theshold Limit Vaules for Physical Agents in the Work Environment," Adopted by ACGIH with Intended Changes for 1990–91, pp. 66–69, 114–119.

*Primary Examiner*—Daniel P. Malley

*Attorney, Agent, or Firm*—Finnegan, Henderson, Farabow, Garrett & Dunner, L.L.P.

[57] ABSTRACT

A document exposure apparatus includes a glass plate on which a document original is located, a press cover for covering the glass plate, an open/close discriminating unit for discriminating an open state and a close state of the press cover, an exposure unit, disposed under the glass plate, for illuminating the original with light, and a control unit for controlling the illuminating operation of the exposure unit according to an open/close state of the press cover, which is discriminated by the open/close discriminating unit.

7 Claims, 10 Drawing Sheets

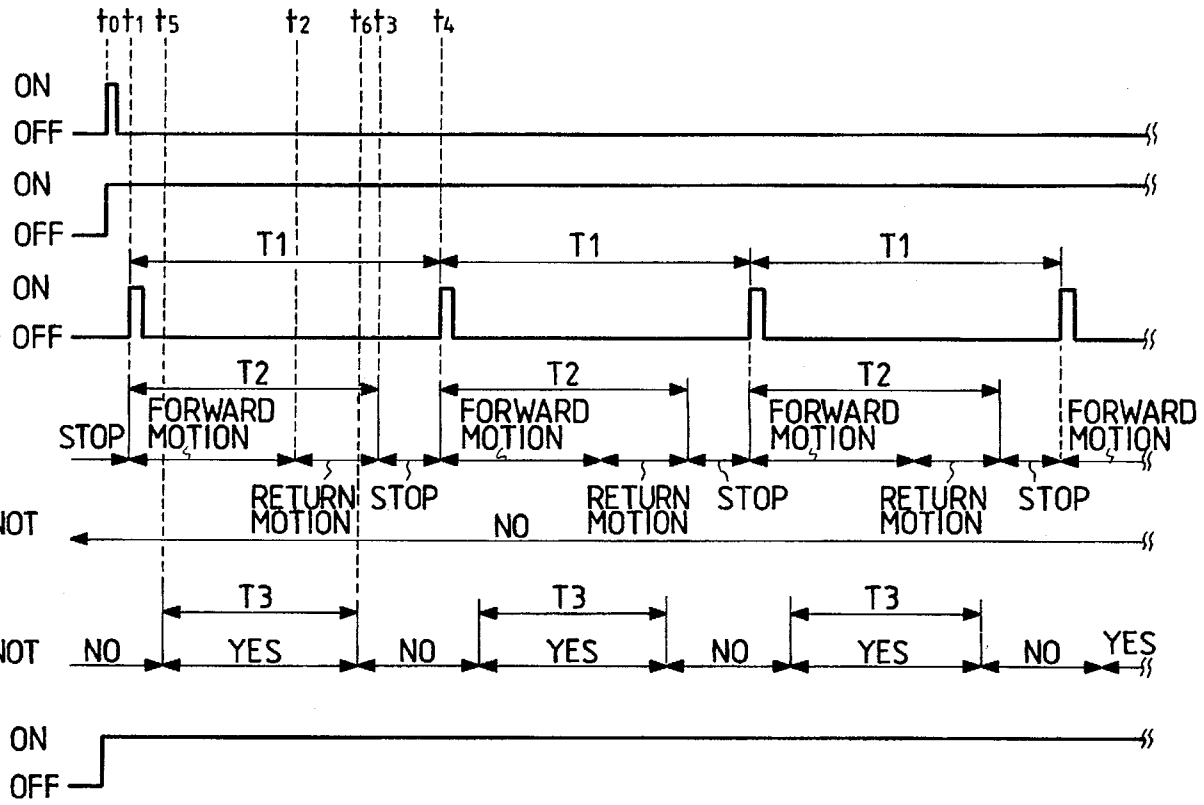
FIG. 5(a) PRINT SWITCH
FIG. 5(b) MAIN MOTOR
FIG. 5(c) COPY CYCLE REFERENCE SIGNAL
FIG. 5(d) STATE OF SCAN UNIT
FIG. 5(e) WHETHER LEAKING LIGHT EXISTS OR NOT
FIG. 5(e') WHETHER LEAKING LIGHT EXISTS OR NOT
FIG. 5(f) EXPOSURE LAMP
ON
OFF
t0 t1 t5
t2
t6 t3
t4
T1
T2
T3
STOP
FORWARD MOTION
RETURN MOTION
NO
YES

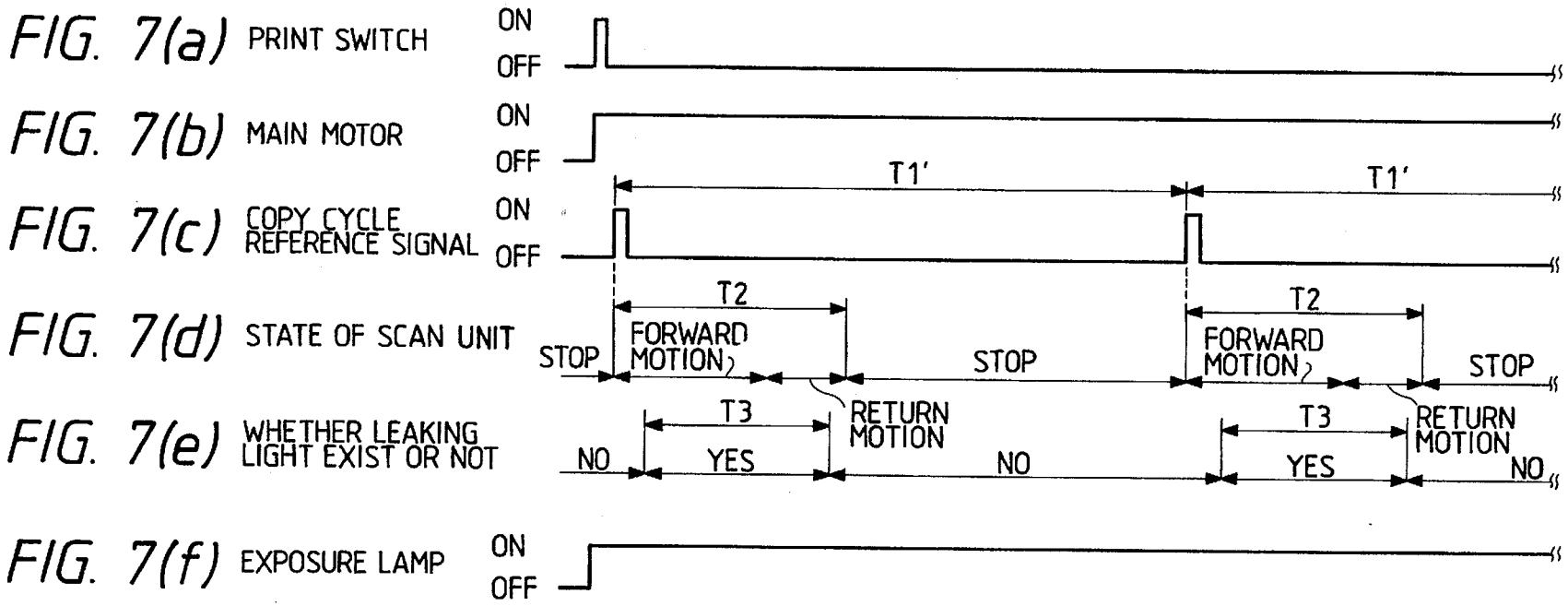
FIG. 7(a) PRINT SWITCH
ON
OFF
FIG. 7(b) MAIN MOTOR
ON
OFF
FIG. 7(c) COPY CYCLE REFERENCE SIGNAL
ON
OFF
FIG. 7(d) STATE OF SCAN UNIT
FIG. 7(e) WHETHER LEAKING LIGHT EXIST OR NOT
FIG. 7(f) EXPOSURE LAMP
ON
OFF
T1'
T1'
T2
T2
T3
T3
STOP
FORWARD MOTION
FORWARD MOTION
RETURN MOTION
RETURN MOTION
STOP
STOP
NO
YES
NO
YES
NO

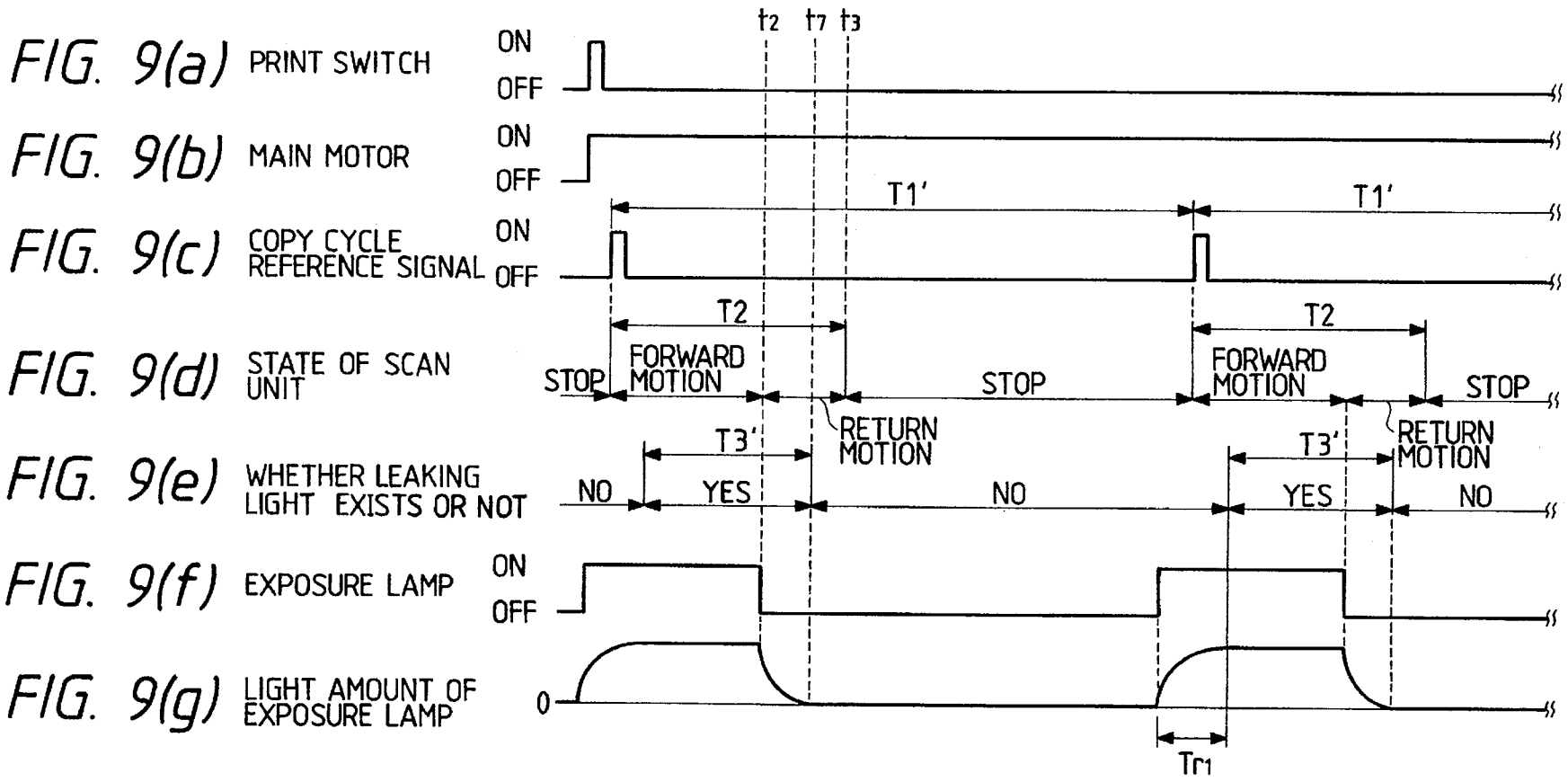
FIG. 9(a) PRINT SWITCH
ON
OFF
FIG. 9(b) MAIN MOTOR
ON
OFF
FIG. 9(c) COPY CYCLE REFERENCE SIGNAL
ON
OFF
FIG. 9(d) STATE OF SCAN UNIT
STOP
FORWARD MOTION
RETURN MOTION
STOP
FORWARD MOTION
RETURN MOTION
STOP
FIG. 9(e) WHETHER LEAKING LIGHT EXISTS OR NOT
NO
YES
NO
YES
NO
FIG. 9(f) EXPOSURE LAMP
ON
OFF
FIG. 9(g) LIGHT AMOUNT OF EXPOSURE LAMP
0
T1'
T1'
T2
T2
T3'
T3'
Tr1
t2
t7
t3

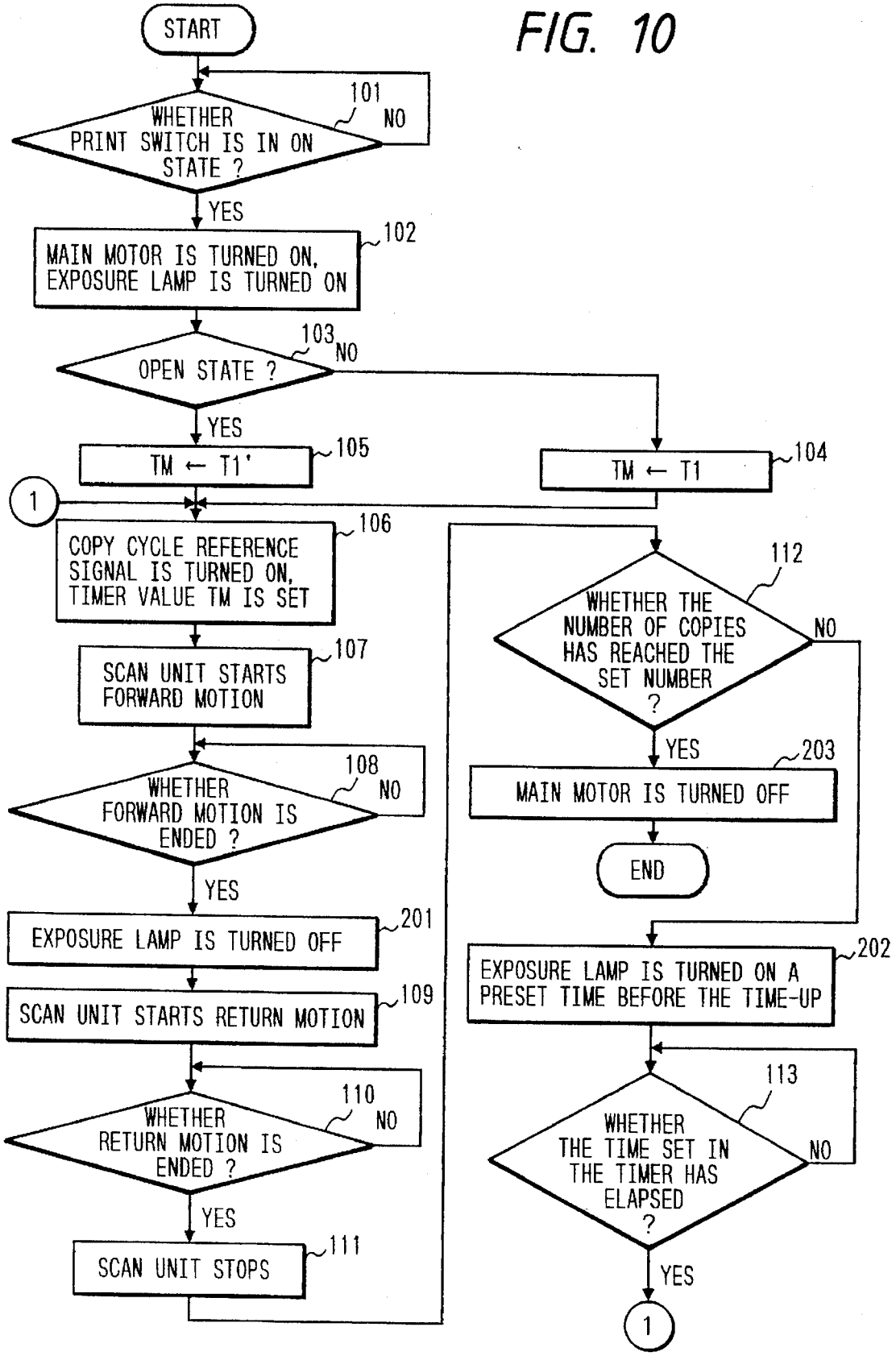
FIG. 10
START
WHETHER PRINT SWITCH IS IN ON STATE ?
101
NO
YES
MAIN MOTOR IS TURNED ON, EXPOSURE LAMP IS TURNED ON
102
OPEN STATE ?
103
NO
YES
TM ← T1'
105
TM ← T1
104
1
COPY CYCLE REFERENCE SIGNAL IS TURNED ON, TIMER VALUE TM IS SET
106
SCAN UNIT STARTS FORWARD MOTION
107
WHETHER FORWARD MOTION IS ENDED ?
108
NO
YES
EXPOSURE LAMP IS TURNED OFF
201
SCAN UNIT STARTS RETURN MOTION
109
WHETHER RETURN MOTION IS ENDED ?
110
NO
YES
SCAN UNIT STOPS
111
WHETHER THE NUMBER OF COPIES HAS REACHED THE SET NUMBER ?
112
NO
YES
MAIN MOTOR IS TURNED OFF
203
END
EXPOSURE LAMP IS TURNED ON A PRESET TIME BEFORE THE TIME-UP
202
WHETHER THE TIME SET IN THE TIMER HAS ELAPSED ?
113
NO
YES
1

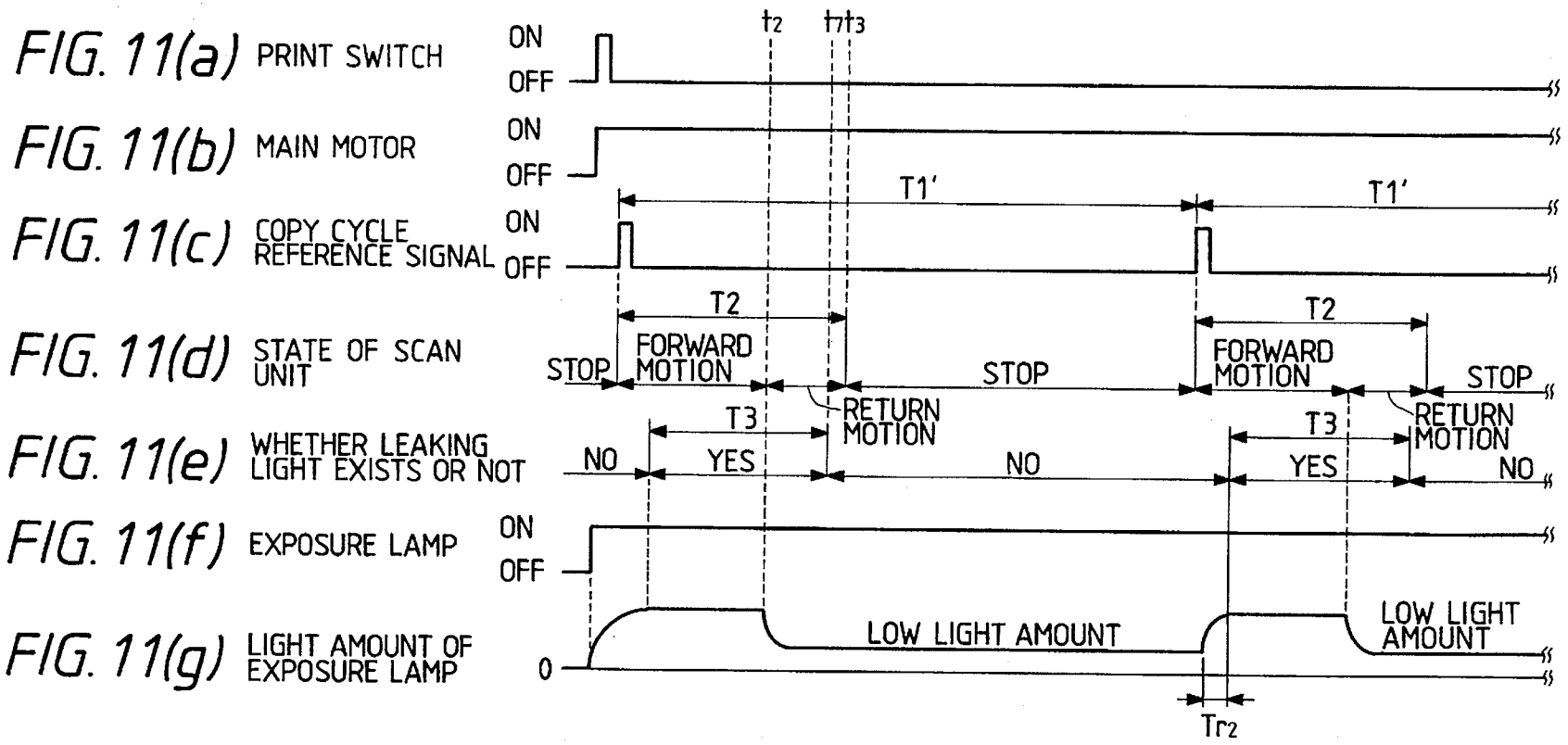
FIG. 11(a) PRINT SWITCH
ON
OFF
FIG. 11(b) MAIN MOTOR
ON
OFF
FIG. 11(c) COPY CYCLE REFERENCE SIGNAL
ON
OFF
FIG. 11(d) STATE OF SCAN UNIT
STOP
FORWARD MOTION
RETURN MOTION
STOP
FORWARD MOTION
RETURN MOTION
STOP
FIG. 11(e) WHETHER LEAKING LIGHT EXISTS OR NOT
NO
YES
NO
YES
NO
FIG. 11(f) EXPOSURE LAMP
ON
OFF
FIG. 11(g) LIGHT AMOUNT OF EXPOSURE LAMP
0
LOW LIGHT AMOUNT
LOW LIGHT AMOUNT
t2
t7t3
T1'
T1'
T2
T2
T3
T3
Tr2

DOCUMENT EXPOSURE APPARATUS

This application is a continuation of application Ser. No. 08/025,719 filed Mar. 3, 1993, now abandoned.

BACKGROUND OF THE INVENTION

The present invention relates to a document exposure apparatus used in an image forming apparatus such as a copying machine or in an image reading apparatus such as a facsimile device. More particularly, the invention relates to a document exposing apparatus which can protect the eyes of an operator against illuminating light leaking from the machine.

In a copying machine, for example, a document original is located on a platen glass, and is illuminated with light emitted from an exposure lamp located under the platen glass. The light reflected by the image surface of the original is imaged on the surface of a charged photoreceptor so that a latent electrostatic image is formed on the surface of the photoreceptor. In some image forming machines, the reflected light is imaged on an image sensor where it is converted into electrical signals. In any case, to read the original image at a high contrast, light of satisfactorily high intensity must be used for illuminating the original.

When a normal original is copied, the rear side of the original located on the platen glass is covered with a document press cover. Accordingly, there is no danger that the illuminating light directly hits the eyes of an operator. When a thick document, for example, a book, is copied, it is frequently copied leaving the press cover open. In this case, there is a possibility that the illuminating light leaking around the document hits the eyes of an operator, possibly damaging the eyes. When an operator mistakenly pushes a start button without a document on the platen and the press cover is left open, more intensive light will enter the operator's eyes.

There have been many proposals to avoid the dangers of the leaked illuminating light hitting the eyes. Japanese Utility Model Publication No. Sho. 53-46016 discloses an exposure safety device in which the copying operation is permitted only when the press cover is substantially closed. Japanese Utility Model Publication No. Sho. 58-12176 discloses a copying machine in which a light-shielding sheet, disposed under the platen glass in a withdrawal manner, is manually withdrawn to cover the area around the region where the document original is placed to shut off the leaking light. Japanese Patent Unexamined Publication No. Sho. 59-52230 discloses a document operating device in which a liquid crystal board as a platen is controlled so that only the exposure area of the platen becomes transparent.

In the exposure safety device disclosed in Japanese Utility Model Publication No. Sho. 53-46016, the copying operation is permitted only when the press cover is substantially closed. To copy a book, for example, the press cover must be opened and closed every time the page is turned over. This manual operation is troublesome. Further, when the object to be copied is thick, such as a thick book, the press cover cannot be closed, so that the machine will not operate for copying.

In the copying machine disclosed in Japanese Utility Model Publication No. Sho. 58-12176, the amount of withdrawing of the light-shielding sheet must be varied in accordance with the size of an original. Thus, the operation is troublesome. Further, the light-shielding sheet and a drive mechanism for moving the sheet for withdrawal are required for the copying machine. This leads to increase of cost to manufacture.

In the device disclosed in Japanese Patent Unexamined Publication No. Sho. 59-52230, a special component such as the liquid crystal board in which the transparency is electrically controlled, is required for shutting off the leaking light. Use of the special component leads to increase of cost. Further, the control circuit for controlling the liquid crystal board is complicated since the transparent region must be moved in synchronism with movement of a light source.

In a case where the illuminating light has such a high intensity that for a short time exposure of the eyes to the illuminating light, the eyes suffer from decline of luminosity factor for blue, retina burn, cataract by infrared-rays, cornea burn, etc., the leaking light must be completely shut off by using the conventional structure as described above. Actually, normal exposure devices rarely use the illuminating light of such a high intensity. However, it is necessary to keep a quantity of accumulated light exposure within a predetermined value, in order to protect the retina from photochemical damage of the eyes which would be caused by a long time exposure of the eyes to illuminating light.

SUMMARY OF THE INVENTION

The present invention has been made in view of the above circumstances and has an object to provide a document exposure apparatus which controls exposure operating conditions in accordance with a degree of opening of the press cover, thereby to protect the eyes of an operator against the illuminating light.

The present invention is based on the fact that a probability that a short-time exposure of the eyes to the illuminating light would damage the eyes is very small, and the damage of the eyes can be prevented if a quantity of accumulated light exposure for a relatively long fixed period of time is limited within a predetermined value.

The document exposure apparatus of the present invention comprises: a glass plate on which a document original is located; a press cover for covering the glass plate, which is freely opened and closed; open/close discriminating means for discriminating an open state and a close state of the press cover; exposure means, disposed under the glass plate, for illuminating the original with light; and control means for controlling the illuminating operation of the exposure means according to an open state and a close state of the press cover, which is discriminated by the discriminating means.

In the document exposing apparatus, the control means controls the exposure means so that when the press cover is in an open state, a quantity of light, leaked when the exposure means is operating and hitting the eyes of an operator, is within a predetermined value for a fixed time. The quantity of this leaking light will be referred to as a "quantity of light exposure to eyes".

When the press cover is in an open state, the control means controls the exposure means so as to satisfy the following mathematical expression by varying at least one of factors T1, T3 and E in the expression.

$$(T/T1)\times T3\times E \leqq H_{MAX}$$

where

T1 : period of exposing operation

T3 : leaking light duration within one cycle of the exposing operation

E : quantity of light exposure to eyes per unit time

T : a fixed time $H_{MAX}$ : maximum of tolerance of the quantity of light exposure to eyes for a fixed time.

The exposure means includes an exposure lamp and exposure scanning means for periodically exposure scanning the document original by moving the exposure lamp relative to the document original. The control means controls the exposure scanning means in a manner that the scanning period in an open state of the press cover is longer than that in the close state.

The control means controls the exposure means in a manner that when the exposure means moves in a first direction, the exposure lamp lights up, and when the exposure means moves in a second direction and is at a standstill, the exposure lamp lights off. Alternatively, the control means controls the exposure means in a manner that when the exposure means moves in a first direction, the exposure lamp lights up at a standard quantity of light, and when the exposure means moves in a second direction and is at a standstill, the exposure lamp lights up at a low quantity of light.

The operation of the invention thus arranged will be described with reference to FIG. 1.

The document exposure apparatus of the invention includes control means 1, which is for varying exposure scanning conditions in an image forming apparatus such as a copying machine, and open/close discriminating means 2 for discriminating an open state and a close state of a press cover. When the open/close discriminating means 2 shows an open state of the press cover and an exposure scan start switch 3 is turned on, the control means 1 changes the exposure scanning conditions to these that are different from those in a normal state of the apparatus, viz., when the press cover is in a close state.

In a case where the start switch 3 is turned on when the press cover is in the close state, the scanning operation for exposure is performed at short periods, which provides the highest copying efficiency. In a case where the start switch 3 is turned on when the press cover is in the open state, the scanning operation is performed for the image formation, under the conditions that the exposure time is unchanged but the exposing period is longer than that when the apparatus is in the normal state. Accordingly, the quantity of the accumulated light exposure to the eyes is low for a fixed period of time. Thus, the leaking light, if hitting the eyes of an operator, will cause little damage to the eyes.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

FIGS. 5(*a*)–5(*g*) are timing charts for explaining the image forming operation;

FIGS. 7(*a*)–7(*f*) are timing charts for explaining the operation of the copying machine according to a first embodiment of the invention when an automatic document feeder contained therein is in an open state;

FIGS. 9(*a*)–9(*g*) are timing charts for explaining the image forming operation in a second embodiment of the invention when an automatic document feeder is in an open state;

FIG. 10 is a flowchart showing the exposure scanning operation in the second embodiment;

FIGS. 11(*a*)–11(*g*) are timing charts for explaining the image forming operation in a third embodiment of the invention when an automatic document feeder is in an open state.

DETAILED DESCRIPTION OF THE PREFERRED EMBODIMENTS

Figure 2:
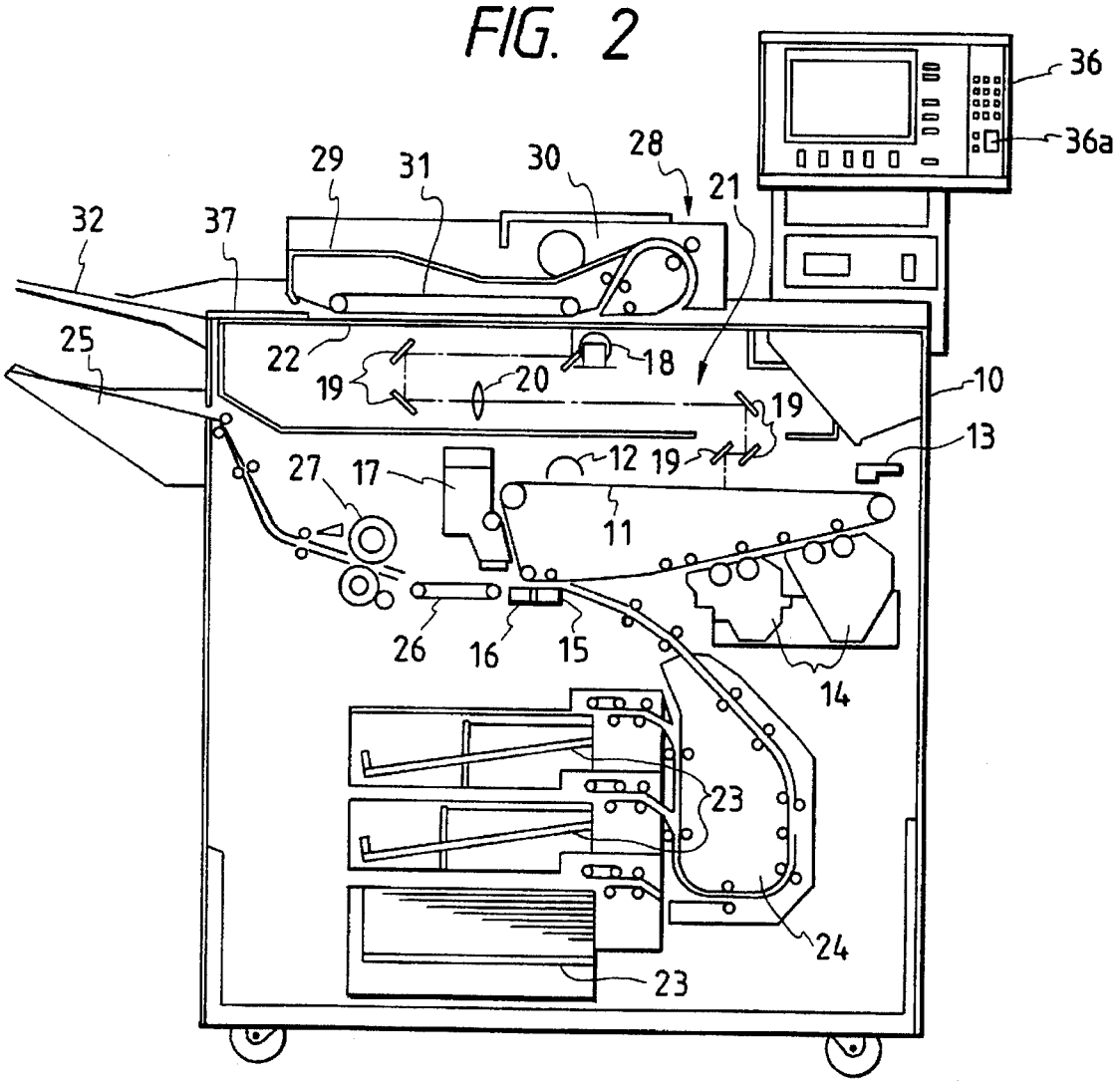
FIG. 2 is a sectional view showing the construction of a copying machine, which incorporates a document exposure apparatus of the invention.

In the description of the present invention that follows, a copying machine will be used as an image forming apparatus to which the present invention is incorporated, for ease of explanation. The construction of the copying machine is illustrated in FIG. 2.

As shown, a photoreceptor 11, which takes the form of a belt, is disposed within a machine body 10 of the copying machine. Disposed around the photoreceptor belt 11 are a charger 12, an unnecessary latent image erase lamp 13, a developing unit 14, a transfer charger 15, a separation charger 16, a cleaning unit 17, and the like in this order as viewed clockwise. An exposure scan unit 21 including an exposure lamp 18, mirror group 19, lens 20 and the like is disposed in the upper part of the machine body 10. A platen glass 22 on which a document original is to be located occupies the top surface of the machine body 10. Paper supply trays 23 and a paper feed unit 24 are disposed in the lower part of the machine body 10. A tray 25 for receiving papers discharged from the machine body is attached to the upper part of the left side (as viewed in the drawing) of the machine body 10. A transport belt 25 and a fixing unit 27 are disposed between a paper peel-off position of the photoreceptor belt 11, i.e., the separation charger 16, and the tray 25.

An automatic document feeder (ADF) 28, which is installed on the machine body 10 in a hinged manner, entirely covers the platen glass 22. The automatic document feeder 28 includes a document tray 29 on which a document original is set, a document feed portion 30 for feeding the document from the document tray 29 to the platen glass 22 of the machine body 10, and a platen belt 31 for transporting the original to a predetermined location on the platen glass 22 and discharging the original to a discharged-original receiving tray 32 after the original is copied.

Figure 1:
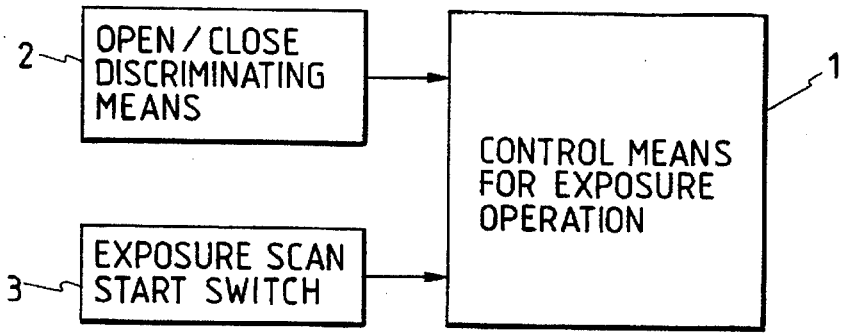
FIG. 1 is a block diagram useful in explaining the technical idea of the present invention.
Figure 3:
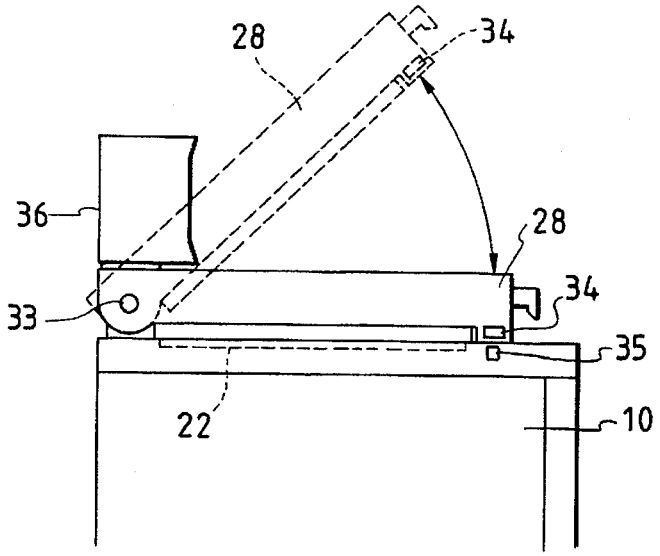
FIG. 3 is a side view showing a mechanical construction for detecting an open/close state of an automatic document feeder.

The automatic document feeder 28, as shown in FIG. 3, is turned, for open and close, about a shaft 33 mounted on the rear side (on the left side in FIG. 3) of the machine body 10. A magnet 34 is attached to the under side of the fore side (right side in FIG. 3) end of the automatic document feeder 28. A reed switch 35, attached to the machine body 10, is located at a position where it is in contact with the magnet 34 when the automatic document feeder 28 is closed. The open state and close state of the automatic document feeder 28 are detected by the reed switch 35. The reed switch 35 corresponds to open/close discriminating means 2 shown in FIG. 1.

A display unit, which includes an operation panel 36, stands upright at the right end of the top of the machine body 10. The operation panel 36 contains various types of instruction switches including a print switch 36*a*. The display unit is provided for displaying the contents of instructions, and operating states of the machine body 10. The print switch 36*a* corresponds to the exposure-scan start switch 3 shown in FIG. 1.

Figure 4:
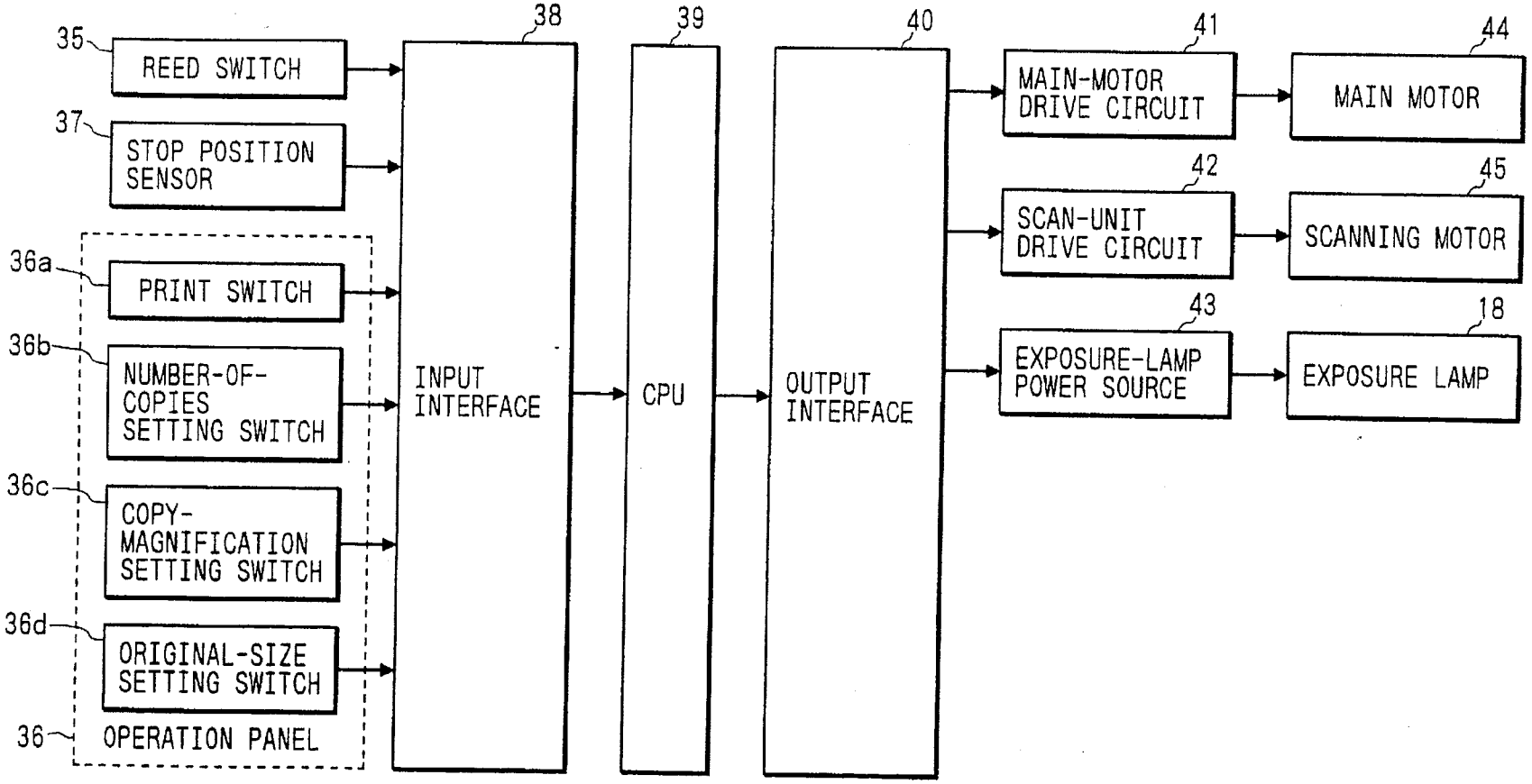
FIG. 4 is a block diagram of a control circuit for controlling the operation of the image forming apparatus.

FIG. 4 is a block diagram showing a control circuit for controlling the operation of the copying machine.

The output signals of the reed switch 35 and a stop position sensor 37 are applied through an input interface 38 to a central processing unit (CPU) 39. The stop position sensor 37 senses that the scan unit 21 is at a stop position called a home position. The CPU 39 includes a ROM (read only memory) storing programs to be executed, a RAM (random access memory) providing a working area, a timer which produces an output signal when a time length set as a timer value has elapsed. The CPU 39 also receives, through the input interface 38, the output signals of various switches on the operation panel 36, such as the print switch 36*a*, a number-or-copies setting switch 36*b*, a copy-magnification setting switch 36*c*, and an original-size setting switch 36*d*. Actually, the output signals of other switches than the above enumerated ones are applied to the CPU 39, but those switches will not be referred to here, for simplicity.

The CPU 39 generates various types of control signals for operating the copying machine at preset sequential timings in accordance with various instructions entered from the operation panel 36 and the output signals of various types of sensors for sensing operating states of the machine. The control signals from the CPU 39 are applied through an output interface 40 to a main-motor drive circuit 41, a scan-unit drive circuit 42, and an exposure-lamp power source 43. The main-motor drive circuit 41 drives a main motor 44 for turning the photoreceptor belt 11. The scan-unit drive circuit 42 drives a scan motor 45 for moving the exposure scan unit 21 in a reciprocative manner. The exposure-lamp power source 43 controls the on/off and/or brightness of a lamp 18 for exposure.

The operation of the copying machine thus constructed will be described.

In a normal use of the copying machine, a document original is located on the platen glass 22, the automatic document feeder 28 is closed covering the original, and the print switch 36*a* is turned on. Then, the copying machine starts the copying operation. The normal operation of the copying machine will be described with reference to FIG. 5 showing a timing chart.

When the print switch 36*a* is turned on (time $t_0$, see FIG. 5(*a*)), the main motor 44 is turned on (see FIG. 5(*b*)), so that the photoreceptor 11 starts to turn, while at the same time the charger 12, disposed near the photoreceptor 11, also starts to operate. The lamp 18 also turns on (see FIG. 5(*f*)). After a preset time ($t_0$ to $t_1$) elapses, a copy cycle reference signal repeats an on-state at fixed time intervals (fixed periods) (see FIG. 5(*c*)). With reference to the copy cycle reference signal, the exposure scan unit 21 cyclically repeats a sequence of the forward motion ($t_1$ to $t_2$), the return motion ($t_2$ to $t_3$), and the stop ($t_3$ to $t_4$), for the image formation (see FIG. 5(*d*)).

Through the reciprocative motions of the scan unit 21, the lamp 18 projects rays of light on the image surface of the original located on the platen glass 22. The reflected light from the original is imaged on the photoreceptor 11 uniformly charged by the charger 12, so that a latent electrostatic image of the original image is formed on the photoreceptor 11. The charge in the nonimage area on the photoreceptor 11 is erased with the erase lamp 13. Thereafter, the latent image is developed by the developing unit 14, thereby forming a toner image. The toner image is transferred by the transfer charger 15 onto a recording paper fed from one of the paper supply trays 23 through the paper feed unit 24. The paper bearing the toner image thereon is peeled off the photoreceptor 11 by means of the separation charger 16. The peeled paper is transported by means of the transport belt 26 to the fixing unit 27 where the toner image is fixed on the paper. Then, the paper having a toner image fixed thereon is discharged into the tray 25. The toner left on the photoreceptor 11 after the transfer process is removed by the cleaning unit 17.

Also when the scan unit 21 moves rearward, the lamp 18 lights on. However, no image is formed during the rearward or return motion because the charges on the photoreceptor 11 have been erased by the erase lamp 13.

The sequence of the forward motion, return motion, and stop is repeated at a fixed period T1, thereby forming a given number of images. The period T1 of the copy cycle reference signal is selected in consideration of the operation speed of the related portions in the copying machine so that the copying machine operates at the highest efficiency, viz., a maximum number of copies per unit time is gained.

In the normal operation of the copying machine as described above, the automatic document feeder 28 is left closed. Therefore, there is no danger that the illuminating light leaks from the machine (see FIG. 5(*e*)).

The operation of the copying machine under the condition that the automatic document feeder 28 is in an open state, will be described. Leakage of light under the worst condition when no original is located on the platen glass 22, will be discussed.

Figure 6:
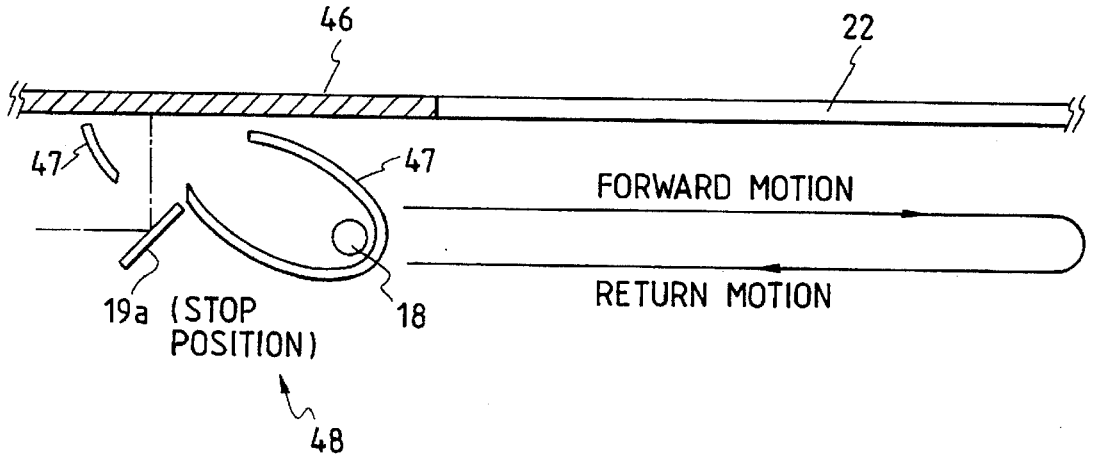
FIG. 6 is a diagram for explaining the movement of an exposure scanning unit.

In the initial state (being stopped), the lamp 18 is positioned under an upper cover 46 located outside the platen glass 22. If the lamp 18 is turned on under this condition, the upper cover 46 shuts off light emitted from the lamp. Accordingly, no light is leaked (see FIG. 5(*e'*), $t_0$ to $t_5$). When the illumination unit 48, which includes the lamp 18, a reflecting plate 47, and a mirror 19*a*, of the scan unit 21 shown in FIG. 2, moves forward to enter the area of the platen glass 22, the light from the lamp 18 is transmitted outside through the platen glass 22 (see FIG. 5(*e'*), $t_5$ to $t_6$) since there is no original. The leakage of the light continues until the illumination unit 48 returns to the location where it is under the upper cover 46. In the one cycle of image formation, the time T3 of the light leakage is shorter than the sum T2 of the time of the forward motion of the illumination unit 48 and the time of the return motion. The reason for this follows. As already described, the stop position of an illumination unit 48 is not underneath the platen glass 22, but under upper cover 46 as shown in FIG. 6. Accordingly, the leaking light is shut off by the upper cover 46 during a certain period of time ($t_1$ to $t_5$) succeeding to the start of the forward motion and another certain period ($t_6$ to $t_0$) preceding to the end of the return motion.

It is said that the eyes are damaged with light when they are exposed to H as an intensity exceeding a predetermined value within a predetermined time. The tolerable quantity of light exposure depends largely on the individual. The maximum tolerable quantity of light exposure must be selected allowing for a satisfactory safety.

The quantity H of light exposure is given by $$H=E*t \quad (1)$$

where E : quantity of light exposure per unit time. The quantity is obtained in a manner such that intensities of light leaked during the reciprocative motions of the scan unit 21 are measured at the position of the eyes, and the average value of the measured light intensities is weighted by a degree of influence of the leaking light on the retina.

t : Exposure time of exposing the eyes to the leaking light.

Accordingly, if the following formula is satisfied within a predetermined period of time T, the illuminating light is not a danger to the eyes.

$$H=E*t\leqq H_{MAX}(t\leqq T) \quad (2)$$

where $H_{MAX}$ : Maximum tolerable quantity of the light exposure.

"1990–1991 Threshold Limit Values for Physical Agents in the Work Environment", issued by ACGIH (American Conference of Government Industrial Hygienists), recommended as follows:

To protect against retinal photochemical inquiry from chronic blue-light exposure, exposure of the eyes to blue light, an integration value of intensities of spectral radiations from a light source, weighted by a danger coefficient Rλ for blue light should be within the following values:

[Formula 1]

$$\sum_{400}^{700} L\lambda\cdot t\cdot B\lambda\cdot\Delta\lambda\leqq 100J\cdot cm^{-2}\cdot sr^{-1} \quad (3)$$
$$(t\leqq 10000\ sec)$$

$$\sum_{400}^{700} L\lambda\cdot B\lambda\cdot\Delta\lambda\leqq 10^{-2}W\cdot cm^{2}\cdot sr^{-1} \quad (4)$$
$$(t\leqq 10000\ sec)$$

where Lλ : Intensity of spectral radiations from a light source

Bλ : Danger coefficient for blue light t : Exposure time exposing the eyes to the leaking light.

Note that λ is measured in nanometers (nm). Wavelengths of light in the visible spectrum correspond to 400 nm to 700 nm.

Δλ: Wavelength interval used in integral calculus.

If the expression (4) is satisfied, there is no limit for the exposure time. For the halogen lamp usually used in the copying machine, the following formula holds

[Formula 2]

$$\sum_{400}^{700} L\lambda\cdot B\lambda\cdot\Delta\lambda\leqq 10^{-2}W\cdot cm^{-2}\cdot sr^{-1}$$

Hence, the exposure time t must be limited so as to satisfy the expression (3).

The quantity E contained in the expression (1) corresponds to

[Formula 3]

$$\sum_{400}^{700} L\lambda\cdot B\lambda\cdot\Delta\lambda$$

The $H_{MAX}$ in the expression (2) corresponds to $100J.cm^{-2}.sr^{-1}$. The fixed time is eight hours.

Under the image forming conditions as charted in FIG. 5, the T/T1 number of copy cycles as maximum are allowed for a fixed time T. Accordingly, when the automatic document feeder 28 is in an open state, the maximum exposure time t is $$t=(T/T1)\times T3.$$

Hence, the maximum quantity H of light exposure will reach the value given by the following equation $$H=(T/T1)\times T3\times E.$$

If the quantity H of light exposure satisfies the following expression $$H\leqq H_{MAX},$$

no problem arises.

If the following inequality holds, $$H>H_{MAX},$$

some measure must be taken.

In the first embodiment of the invention, the period T1' of the copy cycle reference signal (see FIG. 7(*c*)) is set to be longer than the period T1 of the copy cycle reference signal in FIG. 5, when the automatic document feeder 28 is in an open state. The sum T2 of the forward and return motions of the scan unit 21, and the leaking light generation time T3 for one cycle of image formation are equal to those when the automatic document feeder 28 is in a close state (see FIG. 5).

Accordingly, the T/T1' number of copy cycles as maximum are allowed for a fixed time T. Accordingly, when the automatic document feeder 28 is in an open state, the maximum exposure time t will be $$t=(T/T1')\times T3$$

Hence, the maximum quantity H of light exposure will reach the value given by the following equation $$H=(T/T1')\times T3\times E.$$

If T1' is selected so as to satisfy the following formula, $$H=(T/T1')\times T3\times E\leqq H_{MAX},$$

danger of damaging the eyes by the illuminating light can be avoided.

When the original size and the magnification percentage change, the scanning length and the scanning speed also change. Accordingly, the forward/return time T and the leaking light generation time T3 also change. In this case, T1' is selected again according to the original size and the magnification percentage so as to satisfy the following formula $$H=(T/T1')\times T3\times E\leqq H_{MAX}.$$

According to the open and close states, the automatic document feeder 28 switches the period of the copy cycle reference signal between T and T1'. The switching operation will proceed in accordance with a flowchart shown in FIG. 8. A program corresponding to the flowchart is stored in a ROM (not shown) contained in the CPU 39 shown in FIG. 4. In response to various types of input signals which are received through the input interface 38, the CPU 39 performs a predetermined processing and controls the related output portions through the output interface 40.

The CPU 39 constantly detects a state of the print switch 36*a*. When an on state of the print switch 36*a* is detected (step 101), the CPU 39 drives the main motor 44 by the main motor drive circuit 41, while at the same time places the exposure-lamp power source 43 to be in an operating state whereby the lamp 18 lights up (step 102). The CPU 39 determines whether the automatic document feeder 28 is in an open state or a close state on the basis of a state of the reed switch 35 (step 103). When it is a close state, the time T1 is used as a timer value TM (step 104). When it is in an open state, the time T1', which is longer than the time T1, is used as the timer value TM (step 105). Then, the copy cycle reference signal is placed to an on state and the timer value TM is set to a timer (not shown) contained in the CPU 39 (step 106). Then, the CPU 39 causes the scan-unit drive circuit 42 to rotate the scan motor 45 forwardly. As a result, the scan unit 21 starts the forward motion (step 107). The forward moving distance and speed are determined depending on the magnification percentage and the original size, which are respectively entered by a magnification percentage setting switch 36*c* and an original size setting switch 36*d*, both being provided on the operation panel 36. As the magnification percentage becomes larger, the moving speed of the scan unit 21 becomes slower. As the original size becomes larger, the moving distance becomes longer. A value automatically detected may be used for the original size. Following the end of the forward movement (step 108), the scan motor 45 is turned reversely to start the return movement of the scan unit 21 (step 109). When a stop position sensor 37 senses the fact that the scan unit 21 reaches the return end position (step 110), the scan motor 45 is turned off to stop the movement of the scan unit 21 (step 111). Then, the CPU 39 checks if the number of copies thus far made reaches the number of copies previously set by the number-of-copies setting switch 36*b* (step 112). When it does not reach the preset number of copies, the CPU 39 returns to the step 106 after the time set in the timer has elapsed (step 113). When the image formation of the preset number of copies completes, the main motor 44 and the exposure lamp 18 are turned off (step 114), and the image forming operation ends.

As seen from the foregoing description, when the automatic document feeder 28 is in a close state, the time T1 is set to the timer. Thus, the image forming is efficiently carried out with short copy cycles. When the automatic document reeder 28 is in an open state, the time T1', longer than the time T1, is set to the timer. Accordingly, the image formation is carried out with long copy cycles. As a result, the quantity of illuminating light leaking outside the machine is reduced.

A second embodiment of the document exposing apparatus according to the present invention will be described with reference to a timing chart shown in FIG. 9.

The embodiment of FIG. 9 is characterized in that the copy cycle is elongated, and further in that the lamp 18 is turned off when the forward movement of the scan unit 21 terminates (time point t2, see FIG. 9(*f*)). With those features, the leaking light generating time during the return movement of the scan unit 21 is reduced. Accordingly, the leaking light generating time T3' during one cycle of image formation is shorter than that T3 in the timing chart of FIG. 7, Also, the quantity E' of light exposure per unit time is also smaller than the quantity E of light exposure.

The quantity H' of light exposure is given by $$H=(T/T1')\times T3'\times R'.$$

The equation can be rewritten into $$H'<H\leqq H_{MAX}.$$

This mathematic expression teaches that T1' can be reduced till H'=H holds. The time T1' can be reduced within the range of $\Delta T\geqq Tr1$ where $\Delta T=T1'-T3$ and Tr1 is a rise time of the quantity of light from the off time of the lamp 18. The reduction of the time T1' leads to elimination of the wasteful waiting time. Accordingly, where a measure to reduce the quantity of light exposure is taken, the image forming efficiency will not be greatly deteriorated.

FIG. 10 is a flowchart showing the operation of the copying machine that proceeds at the timings shown in FIG. 9.

Figure 8:
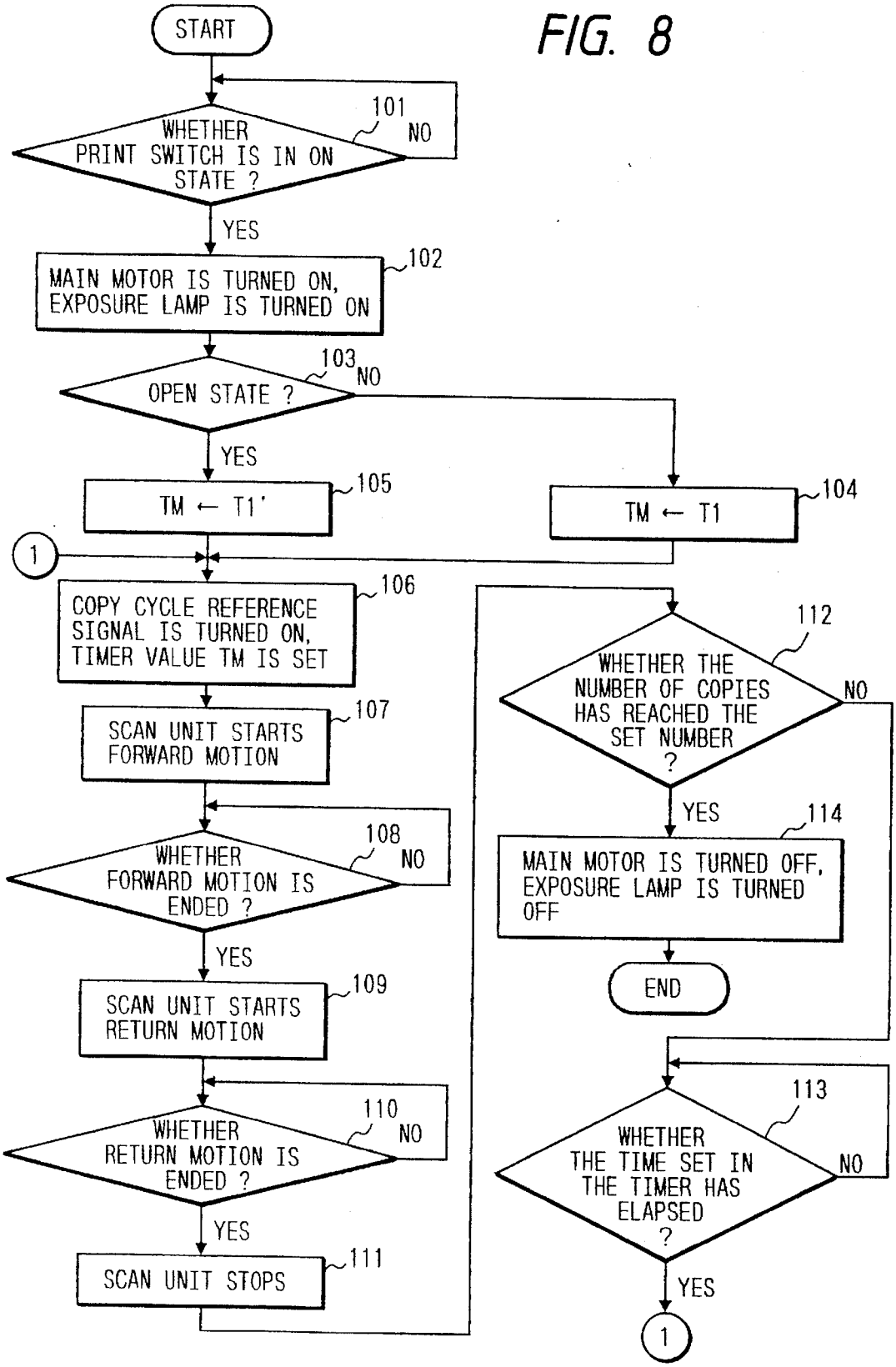
FIG. 8 is a flowchart showing the exposure scanning operation in the first embodiment.

The flowchart of FIG. 10 is substantially the same as that of FIG. 8 except the following points. A step 201 for turning off the lamp 18 is inserted between the steps 108 and 109,. A step 202 for turning on the lamp 18 a preset time before the time-up of the timer is inserted between the steps 112 and 113. A step 203 for turning off the main motor 44 is used in place of the step 114.

A third embodiment of a document exposure apparatus according to the present invention will be described with reference to a timing chart shown in FIG. 11.

The embodiment of FIG. 11 is characterized in that the copy circle is elongated, and further in that the quantity of light emitted from the lamp 18 is reduced when the forward movement of the scan unit 21 terminates (time point t2, see FIG. 11(*g*)).

In the embodiment, the leaking light generating time for one cycle of image formation is T3, equal to that in the timing chart of FIG. 7. However, the quantity E" of light exposure per unit time is smaller than the quantity E of light exposure. Accordingly, the quantity H" of light exposure $$H''=(T/T1')\times T3\times E''$$

satisfies the following inequality $$H''<H\leqq H_{MAX}.$$

This mathematic expression teaches that T1' can be reduced till H"=H holds. The time T1' can be reduced within the range of $\Delta T\geqq Tr2$ where $\Delta T=T1'-T3$ and Tr1 is a rise time of the quantity of light from the low brightness of the lamp 18. The reduction of the time T1' leads to elimination of the wasteful waiting time. Accordingly, where a measure to reduce the quantity of light exposure is taken, the copying efficiency will not be greatly deteriorated.

Figure 12:
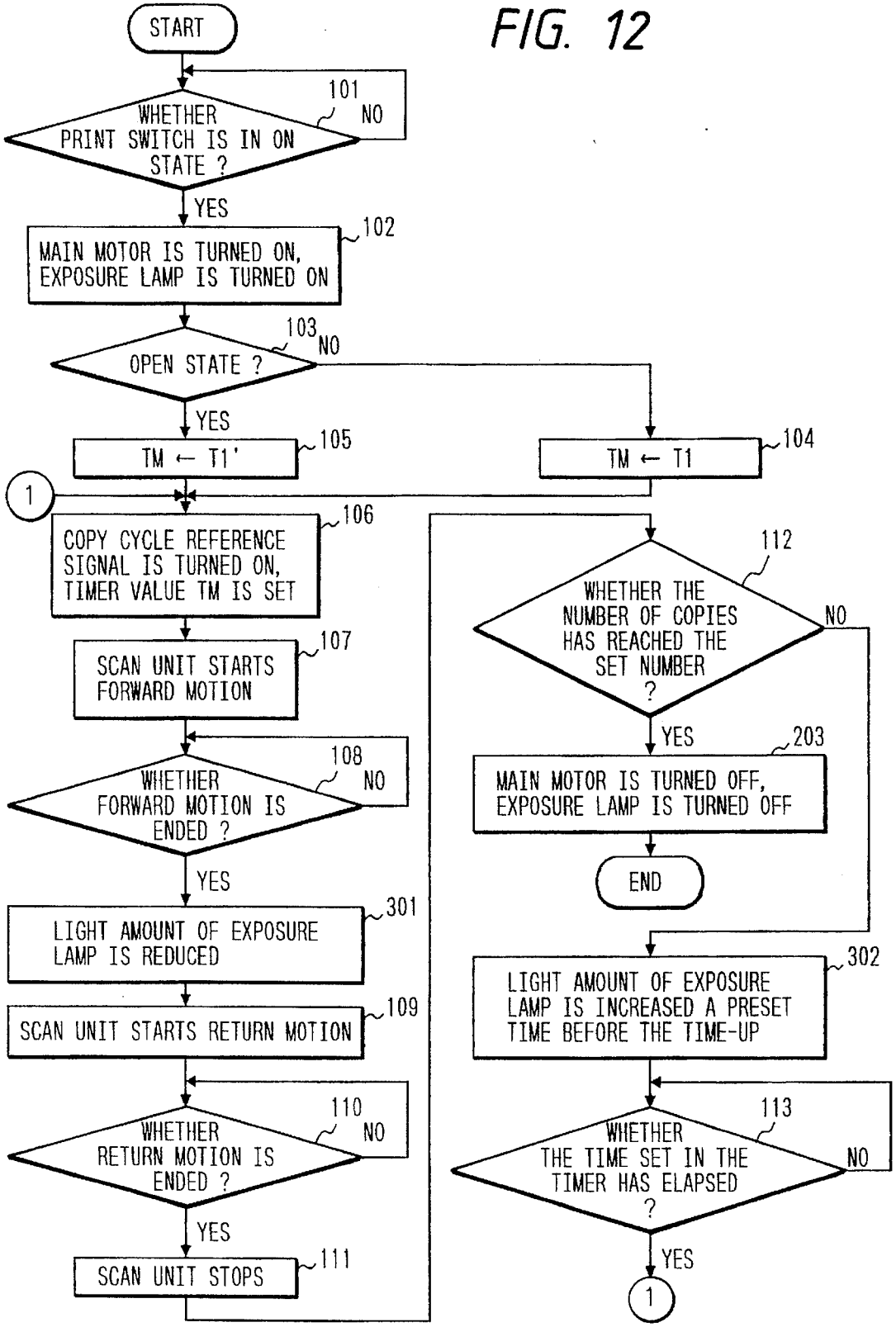
FIG. 12 is a flowchart showing the exposure scanning operation in the third embodiment.

FIG. 12 is a flowchart showing the operation of the copying machine that proceeds at the timings shown in FIG. 11.

The flowchart of FIG. 12 is substantially the same as that of FIG. 8 except the following points. A step 301 for reducing a quantity of light emitting from the lamp 18 is inserted between the steps 108 and 109. A step 302 for increasing the quantity of light from the lamp 18 up to the original one, a preset time before the time-up of the timer is inserted between the steps 112 and 113.

In the present invention, which has been described using the first to third embodiments, the time T1' must be set so as to satisfy the following formula according to the original size and the magnification percentage $$H=(T/T1')\times T3\times E\leqq H_{MAX},$$

since the leaking light generating times are different from each other. To gain the highest copying efficiency, it is necessary to select the time T1' as small as possible by properly combining the first to third embodiments.

The reed switch 35 for detecting an open/close state of the automatic document feeder, the scan-unit drive circuit 42 for driving the scan motor 45, the exposure-lamp power source 43 for controlling the on/off of the lamp 18, and the like are contained in the conventional copying machine. Therefore, to make a reduction of the invention to practice, there is no need of using any additional hardware, but only some change of software is required.

In the copying machine as described above, the scanning system employed is of the type in which the illumination unit 48 including the lamp 18 moves for scan under the platen glass 22. Another suitable scanning system, such as a flash exposure system or a document table moving system, may be used. Also in this case, the time T1' must be selected so as to satisfy the following formula $$H=(T/T1')\times T3\times E\leqq H_{MAX}.$$

In the above-mentioned embodiments, the image forming operation is controlled according to an open/close state of the automatic document feeder 28, which is detected. In the image forming machine of the type in which only the normal press cover is used, viz., the automatic document feeder 28 is not used, only open and close states of the press cover are detected for the same purpose. The press cover may be any type of member if it can press a document original against the platen glass 22 while covering the original therewith. That is, the automatic document feeder is also the press cover.

It is evident that the present invention is applicable not only for the image forming machine such as a copying machine, but also for an image reader.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A document exposure apparatus, comprising:

a glass plate on which a document original is located;

a press cover for covering said glass plate, said press cover being freely opened and closed;

open/close discriminating means for discriminating an open state and a closed state of said press cover;

exposure means, disposed under said glass plate, for illuminating the document original with light; and control means for controlling the illuminating operation of said exposure means according to an open/close state of said press cover so that the period of an exposure cycle when said press cover is in an open state is longer than the period of an exposure cycle when said press cover is in a closed state.

2. The document exposure apparatus according to claim 1, in which said control means controls said exposure means so that a quantity of light which is leaked when said exposure means is operating and hits eyes of an operator, is within a predetermined value for a fixed time.

3. The document exposure apparatus according to claim 2, in which when said press cover is in an open state, said control means controls said exposure means so as to satisfy the following formula by varying at least one of factors T1, T3 and E in the formula, $$(T/T1)\times T3\times E\leqq H_{MAX}$$

where

T1 : period of exposure operation

T3 : time in which light leaks within one cycle of the exposure operation

E : quantity of light exposure to the eyes per unit time

T : a fixed time $H_{MAX}$ : maximum of tolerance of the quantity of light exposure.

4. The document exposure apparatus according to claim 1, in which said exposure means includes an exposure lamp and exposure scanning means for periodically exposure-scanning the original by moving said exposure lamp relative to the original.

5. The document exposure apparatus according to claim 4, in which said control means controls said exposure scanning means in a manner that the period of exposure operation in an open state of said press cover is longer than that in the closed state of said press cover.

6. The document exposure apparatus according to claim 5, in which said control means controls said exposure means in a manner that when said exposure means moves in a first direction, said exposure lamp lights up, and when said exposure means moves in a second direction and is at a standstill, said exposure lamp is turned off.

7. The document exposure apparatus according to claim 5, in which said control means controls said exposure means in a manner that when said exposure means moves in a first direction, said exposure lamp lights up at a first intensity level of light, and when said exposure means moves in a second direction and is at standstill, said exposure lamp lights up at a second intensity level of light lower than the first intensity level of light.

* * * * *

UNITED STATES PATENT AND TRADEMARK OFFICE

CERTIFICATE OF CORRECTION

PATENT NO. : 5,657,113

DATED : August 12, 1997

INVENTOR(S) : Katsuhiko ONO et al.

It is certified that error appears in the above-indentified patent and that said Letters Patent is hereby corrected as shown below:

Claim 3, column 12, line 16, "exposure" should read --exposing--;

line 17, "time in which light leaks" should read --leaking light duration--;

line 19, delete "the"; and line 22, "exposure." should read --exposure to eyes for a fixed time T.--.

Claim 4, column 12, lines 26 and 27, both occurences of "original" should read --document original--.

Claim 5, column 12, line 30, "period of exposure operation" should read --exposure scanning period--.

Signed and Sealed this

FourthDay of August, 1998

Bruce Lehman

*Attest:*

BRUCE LEHMAN

*Attesting Officer*

*Commissioner of Patents and Trademarks*